US005541388A

United States Patent [19]

Gadd

[11] Patent Number: 5,541,388

[45] Date of Patent: Jul. 30, 1996

[54] HEATED GLOVES

[76] Inventor: Pamela R. Gadd, P.O. Box 150743, Nashville, Tenn. 37215

[21] Appl. No.: 365,501

[22] Filed: Dec. 28, 1994

[51] Int. Cl.[6] ..... H05B 3/00

[52] U.S. Cl. ..... 219/211

[58] Field of Search ..... 219/211; 84/322, 84/320, 329

[56] References Cited

U.S. PATENT DOCUMENTS

| | | | |
|---|---|---|---|
| 1,690,860 | 11/1928 | Gonzalez | 84/322 |
| 1,691,472 | 11/1928 | Graham et al. | 219/211 |
| 2,555,203 | 5/1951 | Ramsey | 219/211 |
| 4,195,365 | 4/1980 | Eyman et al. | 441/57 |
| 4,964,174 | 10/1990 | Martin | 2/161.8 |
| 5,186,189 | 2/1993 | Harris | 132/285 |

*Primary Examiner*—Teresa J. Walberg

*Assistant Examiner*—Karl D. Easthom

*Attorney, Agent, or Firm*—Zarley, McKee, Thomte, Voorhees & Sease; Mark D. Frederiksen

[57] ABSTRACT

A heated glove includes a heating wire woven into the fabric of the back of the glove and extending to the distal end of the thumb and finger portions of the glove. The wire is selectively connected to an electrical power source to cause the wire to become warm. In one embodiment of the glove the distal ends of the thumb and finger portions are truncated and have fabric flaps extending from the back side of the finger portions which may be folded over the finger tips. Each flap has the heating wire extending therein to heat the flap. A releasable fastener is applied to the back of the flap to permit securement of the flap in a position folded against the back of the thumb and finger portions. A metal finger pick includes an electrical connector which corresponds with an electrical connector on the flap which is electrically connected to the heating wire, so as to permit heating of the pick when placed on the finger.

5 Claims, 4 Drawing Sheets

HEATED GLOVES

TECHNICAL FIELD

The present invention relates generally to gloves, and more particularly to improved gloves with finger portions which are heated and modified for the playing of musical instruments.

BACKGROUND OF THE INVENTION

It is often necessary for musicians to play their instruments outdoors, whether they are in a marching band or providing an outdoor concert. In order to maintain the dexterity and nimbleness of the fingers, warmth is preferably directed to the entire finger, especially including the finger tips.

While gloves have been known for quite some time, they suffer the drawback of being bulky and inflexible when thick enough to provide meaningful warmth to the fingers. In addition, the layer of thick fabric between the finger tip and the musical instrument to be played will typically prevent the playing of the instrument.

In order to permit the use of the finger tips while playing an instrument and wearing a glove, one method of modifying the prior art gloves was to remove the fingers partially or completely from the glove. While this permitted the fingers to operate the musical instrument, the modified could no longer warm the fingers.

SUMMARY OF THE INVNETION

It is therefore a general object of the present invention to provide a heated glove with heated finger portions including heated hand portion.

Yet another object of the present invention is to provide a heated glove of a thin flexible fabric to permit finger movement and agility.

Still another object is to provide a heated glove with provisions for attachment of a pick to the finger and thumb portions.

A further object of the present invention is to provide a heated glove with special openings to permit contact between the finger tips and specific portions of a musical instrument.

These and other objects will be apparent to those skilled in the art.

The heated glove of the present invention preferably includes a heating wire woven into the fabric of the back of the glove and extending to the distal end of the thumb and finger portions of the glove. The wire may be selectively connected to an electrical power source to cause the wire to become warm. In one embodiment of the glove the distal ends of the thumb and finger portions are truncated and have fabric flaps extending from the back side of the finger portions which may be folded over the finger tips. Each flap has the heating wire extending therein to heat the flap. A releasable fastener is applied to the back of the flap to permit securement of the flap in a position folded against the back of the thumb and finger portions. A metal finger pick includes an electrical connector which corresponds with an electrical connector on the flap which is electrically connected to the heating wire, so as to permit heating of the pick when placed on the finger.

DESCRIPTION OF THE PREFERRED EMBODIMENT

Figure 1:
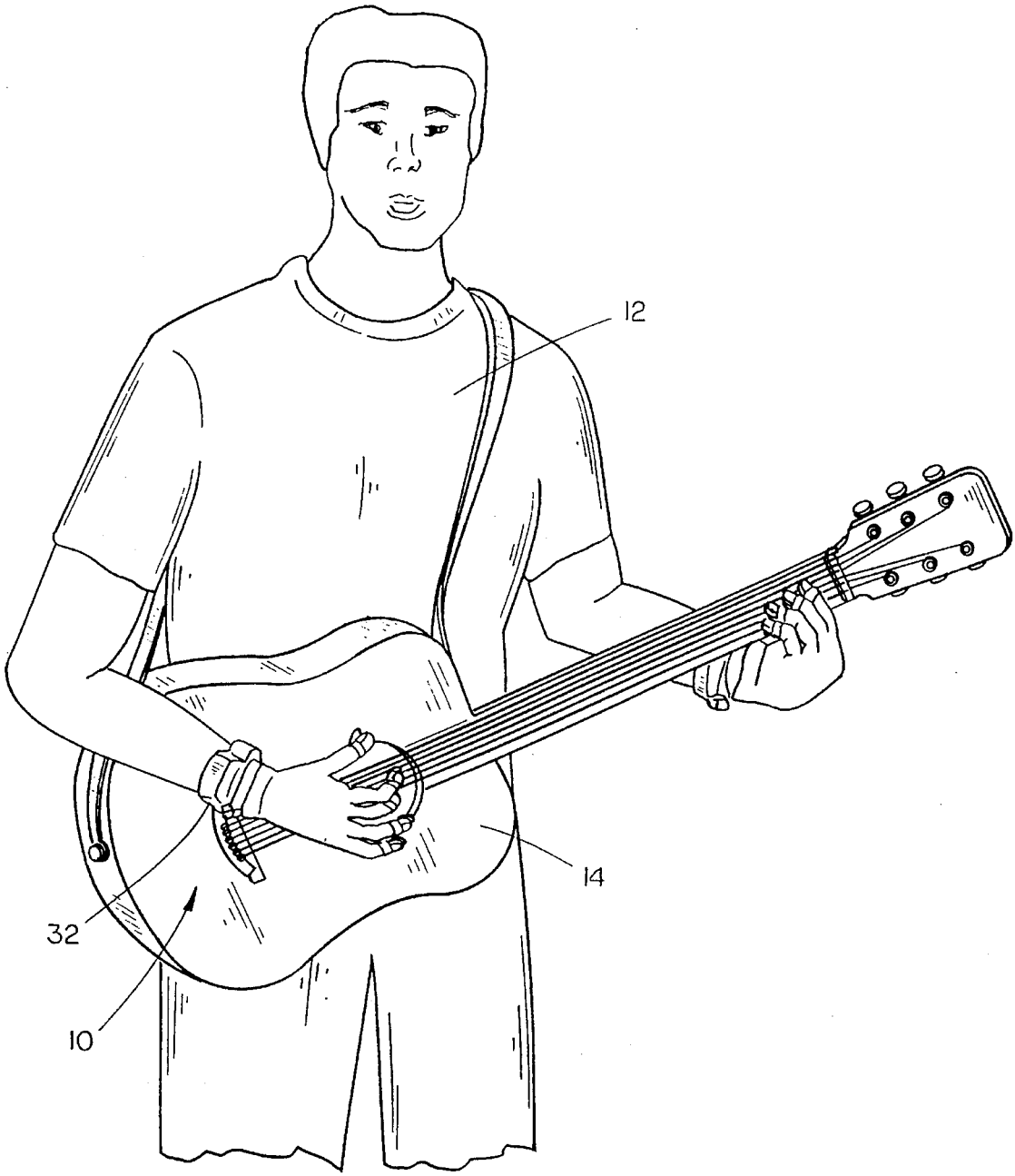
FIG. 1 is a pictorial view of a person wearing the heated glove of the present invention.

Referring now to the drawings, in which similar or corresponding parts are identified with the same reference numeral, and more particularly to FIG. 1, the heated glove of the present invention is identified generally at 10, and is shown being worn by a person 12 playing a musical instrument 14.

Figure 2:
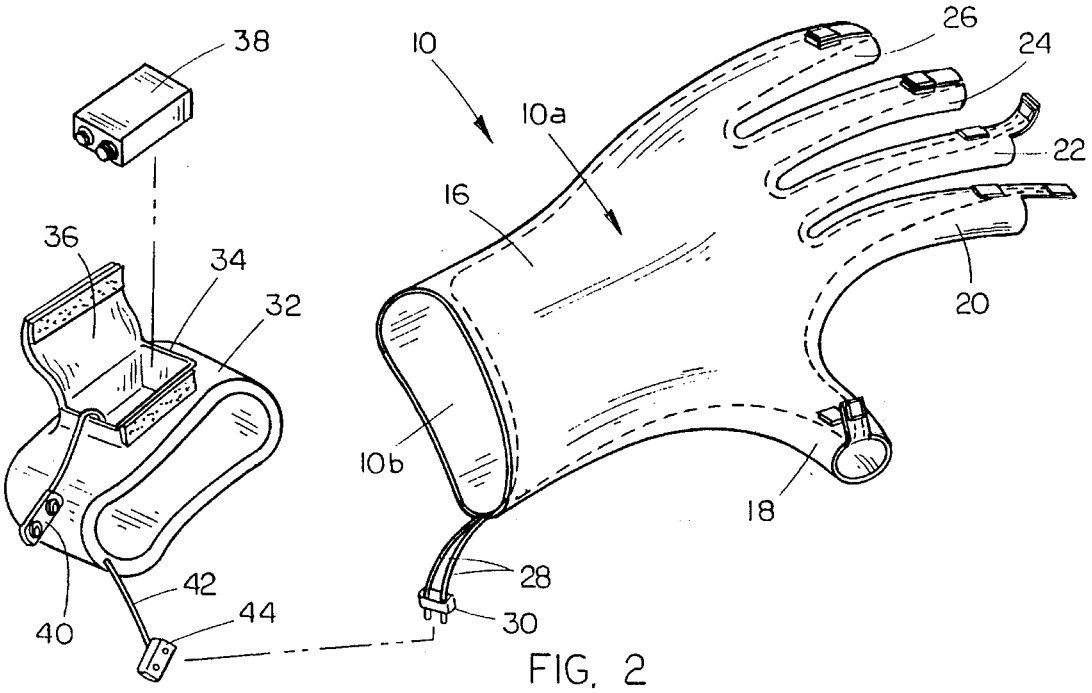
FIG. 2 is an enlarged pictorial view of a glove of the type shown in FIG. 1.

Referring now to FIG. 2, heated glove 10 generally includes a palm portion 16 encompassing the palm and back of the hand, thumb portion 18 encasing the thumb and finger portions 20, 22, 24 and 26 encasing the fingers of the hand. Glove 10 will also be characterized as having a top portion 10*a* and bottom portion 10*b*, bottom portion 10*b* covering the palm side of the hand and top portion 10*a* covering the back side of the hand. Preferably, glove 10 is manufactured of a stretchable fabric, such as LYCRA, which will closely conform to the shape of the hand.

As shown in FIG. 2, a pair of thin wire strands 28 extend from a plug 30 to glove 10, and are embedded in the fabric of top portion 10*a* of glove 10. Wire strands 28 may be interwoven with the fabric of top portion 10*a* or otherwise attached thereto. Wire strands 28 are of a conventional type which will become warm when connected to an electrical power source.

An elastic wrist band 32 is provided with glove 10, and supports the power supply for wire strands 28. As shown in FIG. 2, wrist band 32 includes a battery compartment 34 having an operable lid 36 to enclose a battery 38 therein. Battery 38 has its terminals connected through wires 42 to a socket 44 cooperable with plug 30. In this way, wristband 32 provides electrical power from battery 38 through socket 44 to plug 30 and glove 10.

Although a wristband 32 is shown in the drawings, it is contemplated that the power source could be solar powered or some other type of battery, and that the power source could be mounted in other locations. For example, a larger battery could be worn on the belt, with wires extending from the belt to the glove. In addition, wristband 32 could be directly attached and made a part of glove 10. In this way, glove 10 would be a completely self-sustained heating unit.

Figure 8:
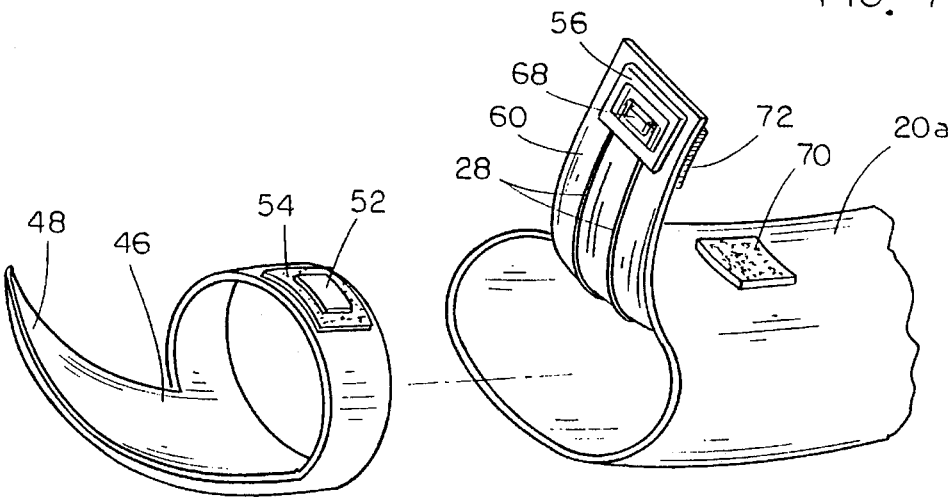
FIG. 8 is a super enlarged perspective view of the glove and pick shown in FIG. 7.

FIGS. 5–8 show glove 10 worn on a hand, with picks 46 connected to thumb portion 18 and finger portions 20 and 22. FIG. 8 shows an enlarged view of the connection of pick 46 to finger portion 20. Preferably, pick 46 is a metal clip with a curved base portion 48 utilized in plucking the strings of an instrument, and a generally ring-shaped connector portion 50 which is durable for a finger to support the pick on the finger. A small pad 52 projects outwardly from connector portion 50 diametric to base portion 48, and may be formed by depressing a portion of the clip or adding a thin layer to the clip. In any event, pad 52 is metal and is in direct contact with connect portion 50. A strip of hook fastener material 54 surrounds pad 52 and is cooperable with a similar strip of loop fastener material 56 on a projecting flap 60 of finger portion 20, as described in more detail hereinbelow.

Figure 5:
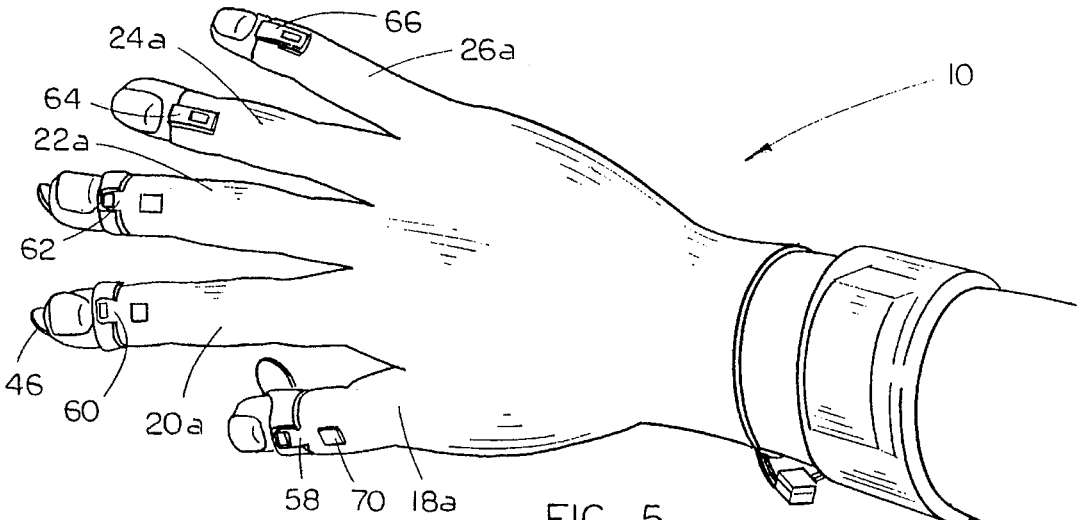
FIG. 5 is a top view of the glove of FIG. 2 worn on a hand with picks attached to the glove.

As shown in FIGS. 2 and 5, thumb portion 18 and finger portions 20-26 each have truncated finger tips with an extending flap 58, 60, 62, 64 and 66, respectively, extending from the top portion 18*a*, 20*a*, 22*a*, 24*a*, and 26*a* of glove 10.

FIGS. 2 and 8 show that wire strands 28 extend along the top portion 20*a* of finger portion 20 and up into flap 60 to a projecting nub 68 of metal or other electrically conductive material. Loop fastener strip 56 surrounds nub 68 such that nub 68 is in electrical contact with pad 52 when loop fastener strip 56 is cooperably fastened with hook fastener strip 54. Electrical current is thereby connected to metal pick 46 to provide heat to pick 46.

Figure 6:
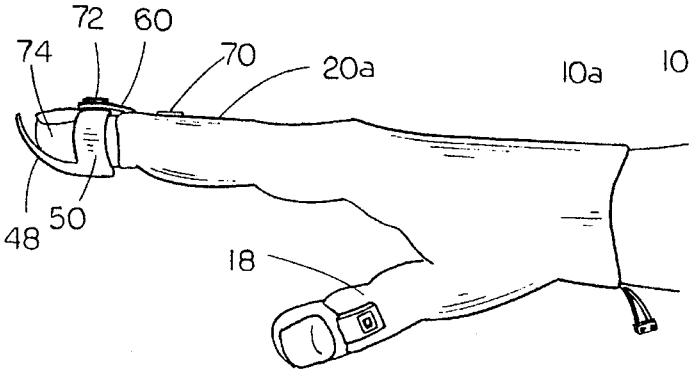
FIG. 6 is a side elevational view taken from the bottom of FIG. 5.
Figure 7:
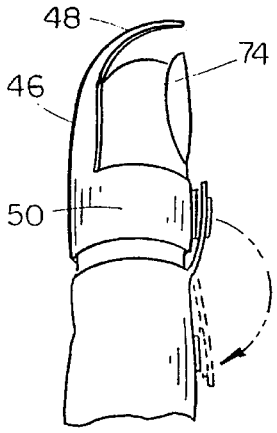
FIG. 7 is an enlarged side elevational view of a portion of FIG. 6.

The top surface 20*a* of finger portion 20 includes a small patch 70 of hook fastener material, spaced rearwardly from flap 60. A corresponding patch 72 of loop fastener material is mounted to the top surface 60a of flap 60. In this way, flap 60 may be folded rearwardly to reveal the finger tip 74 of the user's hand (as shown in FIG. 6). Patches 70 are mounted on the top surface of each of thumb and finger portions 18*a*–26*a* to permit the folding back of flaps 58-68. FIG. 5 shows flaps 64 and 66 folded back and fastened to expose the finger tips of the hand, with picks 46 on thumb portion 18 and finger portions 20 and 22 of glove 10. In this way, picks may be utilized on any one or more of the thumb or fingers of the hand, and electrically connected to the power source to heat the attached pick.

Figure 3:
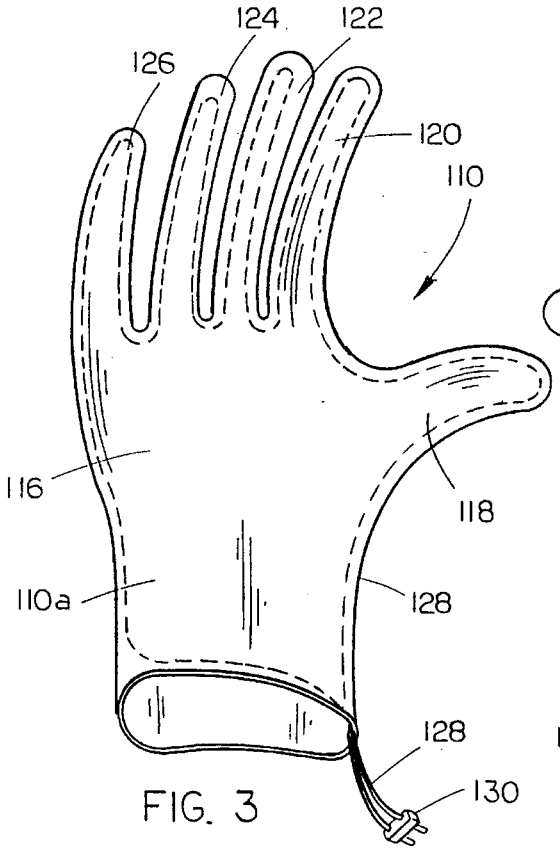
FIG. 3 is a top view of a second embodiment of a heated glove.
Figure 4:
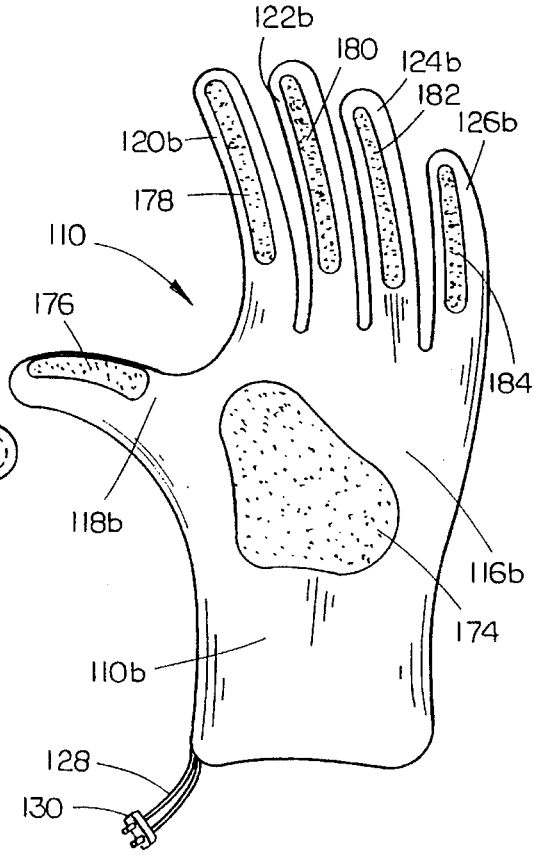
FIG. 4 is a bottom view of the glove of FIG. 3.

Referring now to FIGS. 3 and 4, a second embodiment of the heated glove is designated generally at 110 and includes a top surface 110*a* and bottom surface 110*b*. As with the first embodiment, the second embodiment 110 includes a palm portion 116, thumb portion 118 and finger portions 120, 122, 124, and 126. Wire strands 128 are embedded in the top portion 110*a* of glove 110 and extend to the tips of thumb portion 118 and finger portions 120–126.

The second embodiment of glove 110 is designed for use with a person that does not require the fingers of the hand to directly contact the musical instrument. For example, glove 110 may be utilized by a drummer. For this reason, the finger tips of the glove are not truncated. However, the bottom surface 110*b* of glove 110 includes gripper portions 174, 176, 178, 180, 182 and 184 located on the bottom surfaces of the palm portion 116*b*, thumb portion 118*b* and finger portions 120*b*–126*b*, respectively. Gripper portions 174–184 are preferably projecting rubber knobs or a similar type of material which promotes friction to permit the grasping of drumsticks or the like. Wire strands 128 are connected to a plug 130 which is turn may be connected to a power source to heat the gloves.

Figure 10:
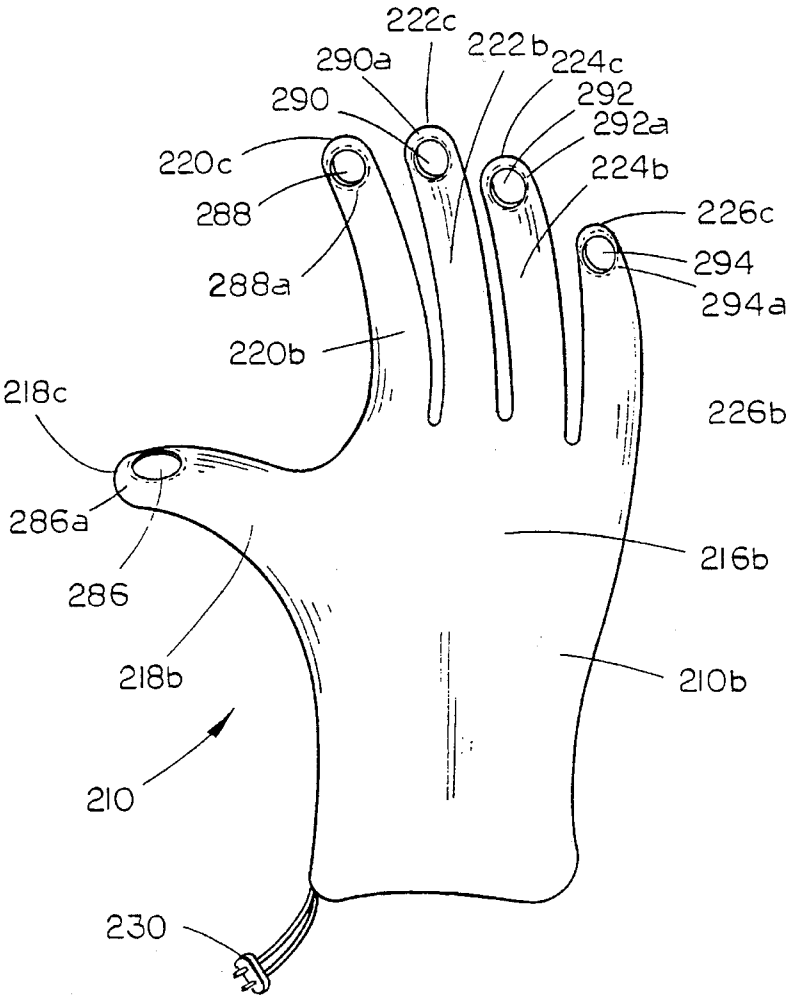
FIG. 10 is a bottom view of the glove of FIG. 9.
Figure 9:
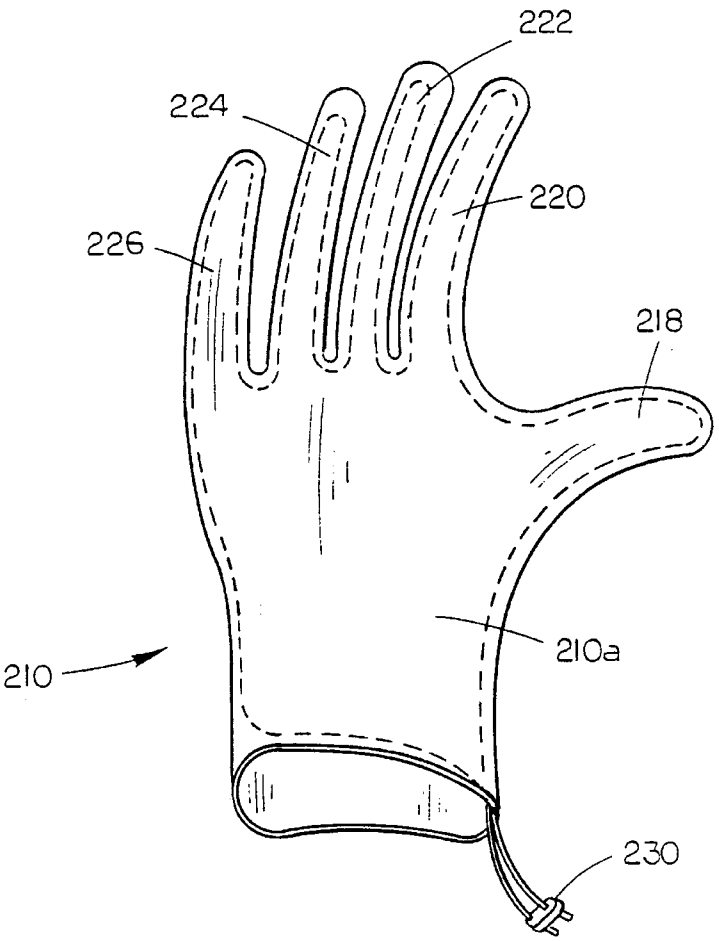
FIG. 9 is a top view of a third embodiment of the heated glove.

Referring now to FIGS. 9 and 10, a third embodiment of the heated glove is designated generally at 210 and includes a top surface 210*a* and bottom surface 210*b*. As with the first and second embodiments, the third embodiment 210 includes a palm portion 216, thumb portion 218 and finger portions 220, 222, 224 and 226. Wire strands 228 are embedded in the top surface 210*a* of glove 210 and extend to the tips of thumb portion 218 and finger portion 220–226 (as shown in FIG. 9).

The third embodiment of glove 210 is designed for use with a person requiring the fingers of the hand to directly contact a musical instrument. For example, glove 210 may be utilized by a musician who plays a flute, clarinet, or the like. Because flutes and similar instruments require sealed contact between the fingers and the openings on the instrument, glove 210 includes a hole 286 in thumb portion bottom surface 218*b*, and holes 288, 290, 292 and 294 in finger portion bottom surfaces 220*b*, 2222*b*, 224*b* and 226*b*, respectively. Holes 286–294 are positioned under the thumb and finger tips and are sized to permit complete covering of an instrument aperture by the finger surface. Preferably, holes 286–294 include a stitched border 286*a*–294*a* which prevents the glove edges around the hole from fraying.

It is important to note that holes 286–294 are located entirely on the bottom surface 210*b* of glove 210 such that the distal ends 218*c*, 220*c*, 222*c*, 224*c* and 226*c* of thumb portion 218 and finger portions 220–226 are covered, as shown in FIG. 10. In this way, only a very small portion of the glove directly over the portion of the finger utilized to play the instrument is open for contact with the musical instrument.

In the case of an instrument such as a trumpet, the glove bottom finger portion could have an elastic bordered slit where a finger could then be slipped through the slit opening, over the key of the instrument, thereby insulating the area where the finger tip contacts the key.

Whereas the invention has been shown and described in connection with the preferred embodiments thereof, it will be understood that many modifications, substitutions and additions may be made which are within the intended broad scope of the appended claims. There has therefore been shown and described an improved heated glove which accomplishes at least all of the above stated objects.

I claim:

1. A heated glove, comprising: a flexible fabric glove having a palm side, a back side, a thumb portion and four finger portions, said thumb and finger portions each having a distal end; each of said thumb and finger portions including heating means mounted in the back sides thereof for warming a hand inserted therein; said thumb and finger portions having truncated distal ends through which finger tips will project when the glove is placed on a hand; and a flap of fabric projecting distally from the distal end of the back side of said thumb and finger portions.

2. The glove of claim 1, wherein said heating means extends into each of said flaps.

3. The glove of claim 2, wherein said flaps each include one-half of a cooperable fastener on the back side thereof, and wherein each of said thumb and finger portions include a corresponding half of a cooperable fastener, such that said flaps may be selectively fastened against the backs of the thumb and finger portions.

4. The glove of claim 3, wherein said heating means includes:

a wire attached to said fabric, adapted to become warm when an electrical current is conducted therethrough; and a source of electrical power selectively connected to said wire to conduct current therethrough.

5.The glove of claim 4, wherein said wire extends into each said flap.

* * * * *